US011980235B2

(12) United States Patent
Yoon

(10) Patent No.: US 11,980,235 B2
(45) Date of Patent: May 14, 2024

(54) AEROSOL GENERATING DEVICE, CLEANING KIT FOR AEROSOL GENERATING DEVICE AND AEROSOL GENERATING SYSTEM

(71) Applicant: KT&G CORPORATION, Daejeon (KR)

(72) Inventor: Sung Wook Yoon, Suwon-si (KR)

(73) Assignee: KT&G CORPORATION, Daejeon (KR)

( * ) Notice: Subject to any disclaimer, the term of this patent is extended or adjusted under 35 U.S.C. 154(b) by 908 days.

(21) Appl. No.: 16/975,932

(22) PCT Filed: May 14, 2020

(86) PCT No.: PCT/KR2020/006376

§ 371 (c)(1),
(2) Date: Aug. 26, 2020

(87) PCT Pub. No.: WO2020/231208

PCT Pub. Date: Nov. 19, 2020

(65) Prior Publication Data

US 2023/0094786 A1 Mar. 30, 2023

(30) Foreign Application Priority Data

May 14, 2019 (KR) ..... 10-2019-0056555

(51) Int. Cl.
*A24F 40/20* (2020.01)
*A24F 40/50* (2020.01)
(Continued)

(52) U.S. Cl.
CPC ..... *A24F 40/85* (2020.01); *A24F 40/50* (2020.01); *A24F 40/95* (2020.01); *A24F 40/20* (2020.01); *A24F 40/51* (2020.01)

(58) Field of Classification Search
CPC ..... A24F 40/20; A24F 40/50; A24F 40/51; A24F 40/85; A24F 40/95
See application file for complete search history.

(56) References Cited

U.S. PATENT DOCUMENTS 5,878,752 A * 3/1999 Adams ..... A24F 40/465 131/194
6,119,700 A * 9/2000 Fleischhauer ..... A24F 9/04 15/104.16

(Continued)

FOREIGN PATENT DOCUMENTS

CN 104203018 A 12/2014
CN 204091003 U 1/2015

(Continued)

OTHER PUBLICATIONS

International Search Report dated Dec. 18, 2020 from the Korean Intellectual Property Office in Application No. PCT/KR2020/006376.

(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

An aerosol generating device according to an embodiment may include a case including an accommodation space for accommodating at least a part of an aerosol generating article; a heater that heats the aerosol generating article accommodated in the accommodation space to generate aerosol; and an air circulator that generates air flow to discharge air in the accommodation space to outside.

15 Claims, 8 Drawing Sheets

(51) Int. Cl.
*A24F 40/85* (2020.01)
*A24F 40/95* (2020.01)
*A24F 40/51* (2020.01)

(56) References Cited

U.S. PATENT DOCUMENTS

| | | | | |
|---|---|---|---|---|
| 9,687,028 | B2 | 6/2017 | Park | |
| 2004/0149737 | A1* | 8/2004 | Sharpe | A24F 40/465 219/635 |
| 2014/0348495 | A1* | 11/2014 | Greim | A24F 40/85 392/386 |
| 2016/0088874 | A1* | 3/2016 | Lipowicz | A24F 40/42 451/163 |
| 2020/0093177 | A1 | 3/2020 | Han et al. | |
| 2020/0154776 | A1* | 5/2020 | Lee | A46B 15/0097 |
| 2020/0268055 | A1 | 8/2020 | An | |
| 2020/0288778 | A1 | 9/2020 | Kim et al. | |
| 2020/0350773 | A1* | 11/2020 | Fernando | H02J 7/00036 |
| 2021/0137163 | A1* | 5/2021 | An | A24F 40/40 |

FOREIGN PATENT DOCUMENTS

| | | | | |
|---|---|---|---|---|
| CN | 108354236 | A * | 8/2018 | A24F 47/008 |
| CN | 108354236 | A | 8/2018 | |
| CN | 108552591 | A | 9/2018 | |
| CN | 207836767 | U | 9/2018 | |
| CN | 108851224 | A | 11/2018 | |
| CN | 208573039 | U | 3/2019 | |
| JP | 6261803 | B1 | 1/2018 | |
| JP | 2019-80533 | A | 5/2019 | |
| KR | 10-2018-0070442 | A | 6/2018 | |
| KR | 10-1967604 | B1 | 4/2019 | |
| KR | 10-2019-0049415 | A | 5/2019 | |
| WO | 2016124550 | A1 | 8/2016 | |
| WO | 2019/088074 | A1 | 5/2019 | |

OTHER PUBLICATIONS

Communication dated Dec. 7, 2020 from the Korean Intellectual Property Office in Application No. 10-2019-0056555.
Office Action dated Apr. 19, 2023 from the Chinese Patent in Application No. 202080002070.4.
Communication dated Dec. 14, 2021 from the European Patent Office in European Application No. 20760745.8.
Partial European Search Report dated Sep. 2, 2022 in European Application No. 22182998.9.

* cited by examiner

【Figure 1】
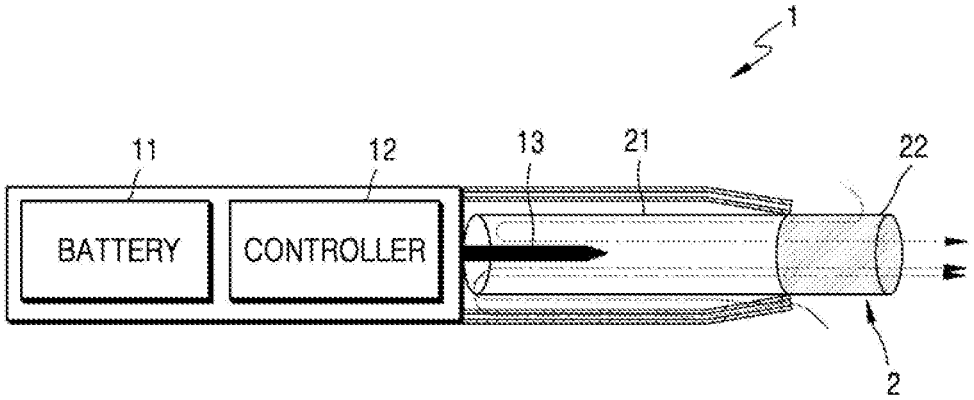
【Figure 2】
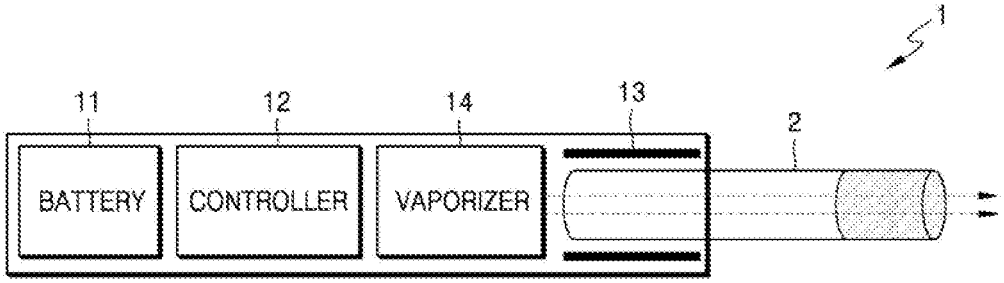
【Figure 3】
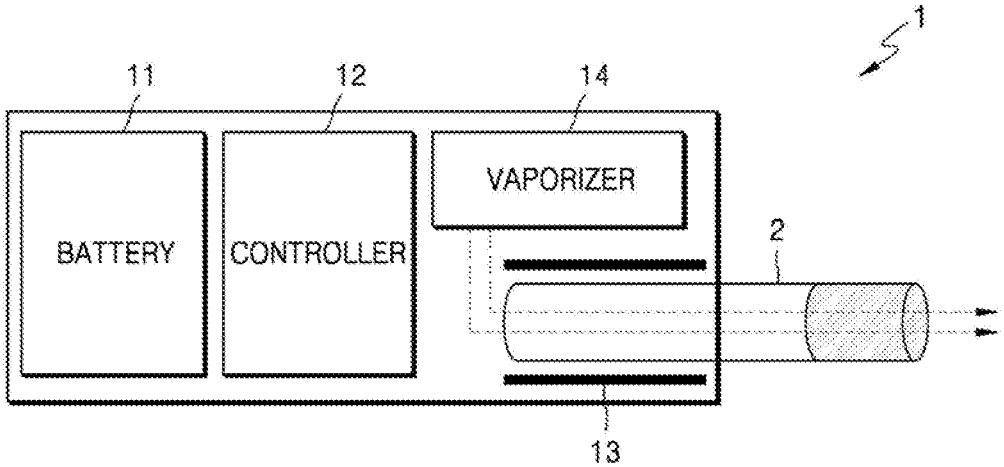

【Figure 5】

【Figure 8】
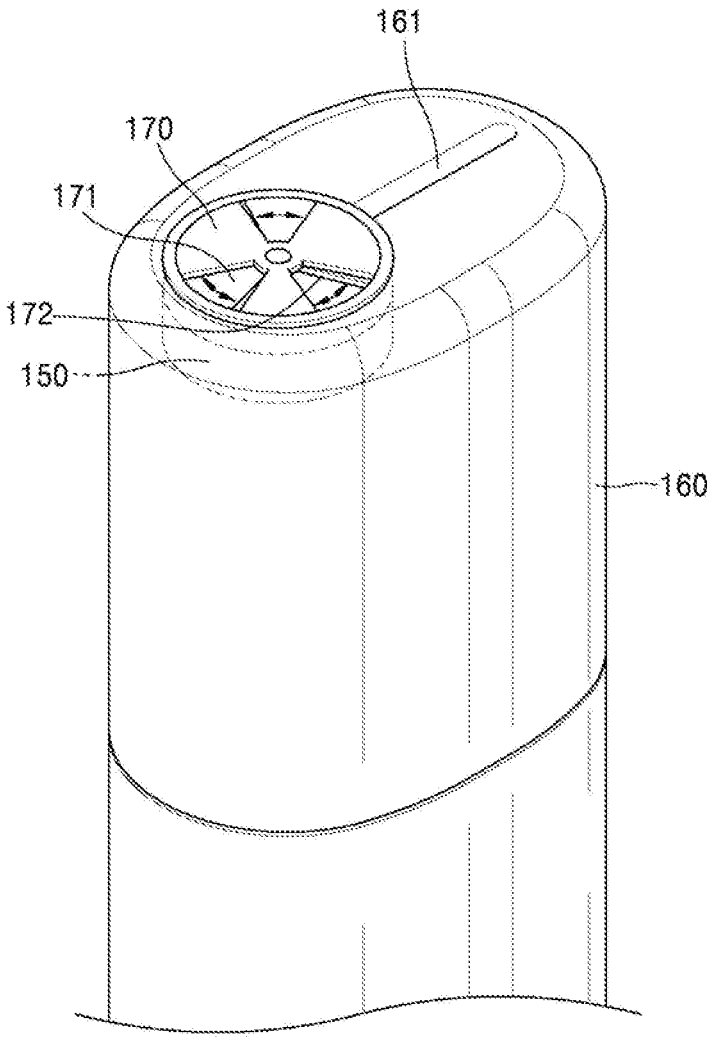

【Figure 9】
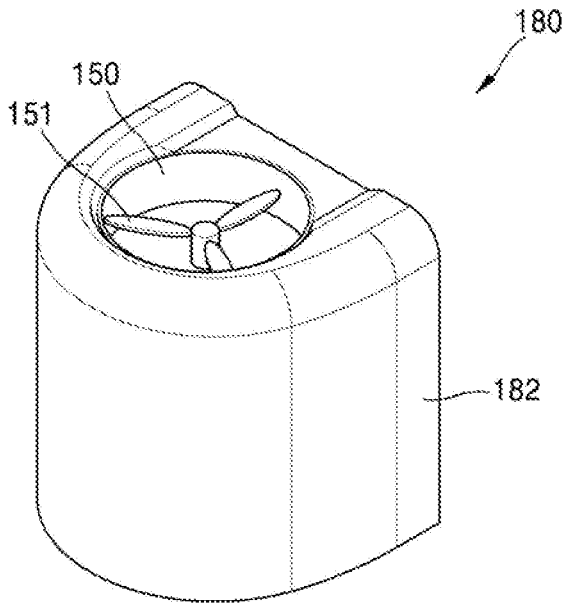
【Figure 10】
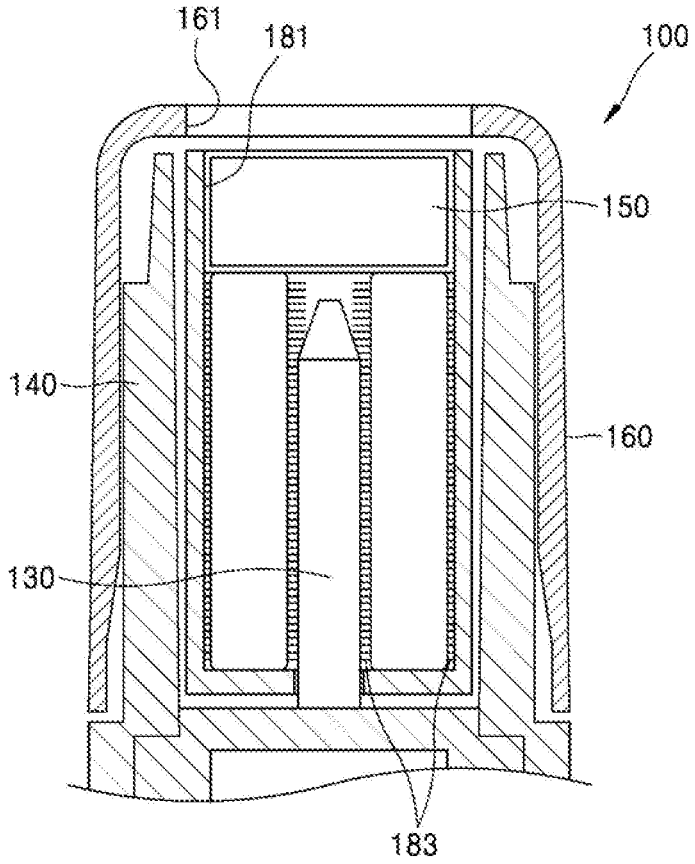

【Figure 11】
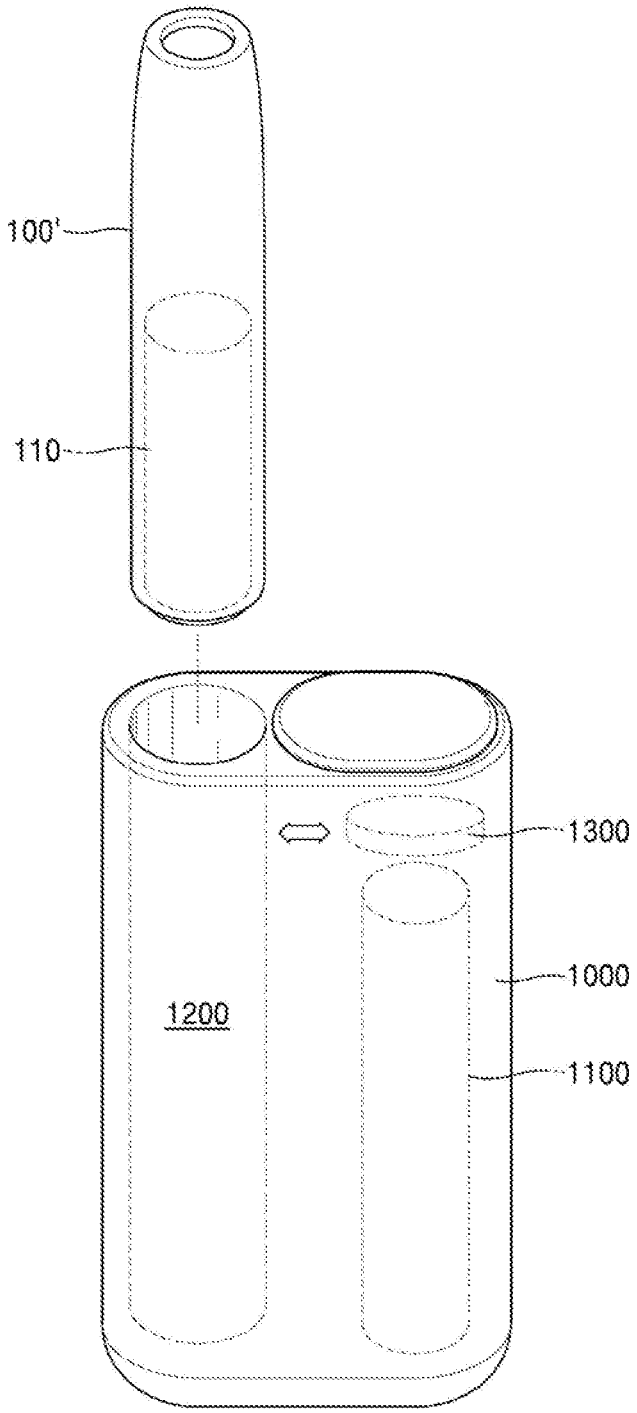

AEROSOL GENERATING DEVICE, CLEANING KIT FOR AEROSOL GENERATING DEVICE AND AEROSOL GENERATING SYSTEM

TECHNICAL FIELD

Embodiments relate to an aerosol generating system, and more particularly, to an aerosol generating system that includes an air circulation device for cleaning an aerosol generating device.

BACKGROUND ART

Recently, the demand for an alternative to traditional cigarettes has increased. For example, there is growing demand for an aerosol generating device that generates aerosol by heating an aerosol generating material in cigarettes, rather than by combusting cigarettes. Accordingly, studies on a heating-type cigarette and a heating-type aerosol generating device have been actively conducted.

In general, liquid droplets and by-products of aerosol may be generated by heating an aerosol generating material, and may remain in a device after using a heated aerosol generating device. Since these by-products and other foreign substances may remain inside the device and leave odor, the aerosol generating device needs regular cleaning.

In cleaning the aerosol generating device, regular ventilation of airflow paths and an accommodation space in which a cigarette is inserted is one of the most effective ways to reduce odor. However, the accommodation space needs to be closed for protection of a heater while the aerosol generating device is not being used, and thus, it is difficult to clean the aerosol generating device by natural ventilation.

DISCLOSURE

Technical Solution

In order to solve the problems, an embodiment provides an aerosol generating device, a cleaning kit for an aerosol generating device, and an aerosol generating system. Further, the embodiments provide an aerosol generating device capable of cleaning or ventilating an accommodation space of the aerosol generating device by installing an air circulation device capable of discharging air in the accommodation space which accommodates a cigarette to the outside, a cleaning kit for the aerosol generating device, and a system for the aerosol generating device.

The problems to be solved by the embodiments are not limited to the above-described problems, and the problems not described will be clearly understood by those skilled in the art in which the present disclosure is involved from the present specification and the accompanying drawings.

As technical means for solving the technical problems described above, an aerosol generating device according to one embodiment may include a case including an accommodation space for accommodating at least a part of an aerosol generating article; a heater that heats the aerosol generating article accommodated in the accommodation space to generate aerosol; and an air circulation device that generates air flow to discharge air in the accommodation space to outside.

Advantageous Effects

An aerosol generating device according to embodiments may generate a flow of air to discharge air in an accommodation space to the outside, remove residual substances capable of remaining in the accommodation space for accommodating a cigarette, and ventilate the accommodation space to remove odor remaining in the accommodation space.

Further, foreign substances attached to a heater and the accommodation space may be effectively removed by a brush.

Effects of the embodiments are not limited to the above-described effects, and effects not described will be clearly understood by those skilled in the art in which the present disclosure is involved from the present specification and the accompanying drawings.

DESCRIPTION OF DRAWINGS

FIGS. 1 through 3 are diagrams showing examples in which a cigarette is inserted into an aerosol generating device.

FIG. 8 is a perspective view illustrating a cover of the aerosol generating device according to an embodiment;

FIG. 9 is a perspective view schematically illustrating a cleaning kit for an aerosol generating device according to an embodiment;

FIG. 10 is a cross-sectional view illustrating a side surface of the cleaning kit according to the embodiment illustrated in FIG. 9; and FIG. 11 is a perspective view schematically illustrating an aerosol generating system including an aerosol generating device and a cradle, according to an embodiment.

BEST MODE

Figure 4:
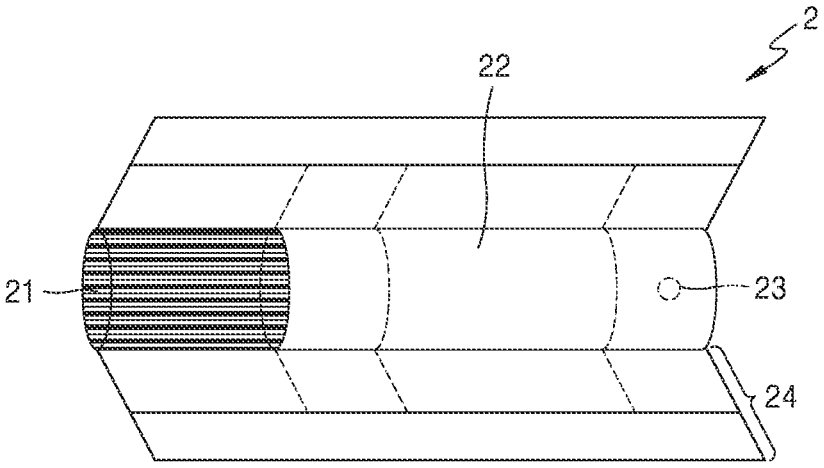
FIG. 4 illustrates an example of the cigarette.

An aerosol generating device according to one embodiment may include a case including an accommodation space for accommodating at least a part of an aerosol generating article; a heater that heats the aerosol generating article accommodated in the accommodation space to generate aerosol; and an air circulator that generates air flow to discharge air in the accommodation space to outside.

Further, the air circulator may move in and out of the accommodation space.

Further, the aerosol generating device may further include a housing that forms an exterior of the aerosol generating device, a guide groove formed in the housing, and a protrusion formed in the air circulator to engage with the guide groove, wherein the protrusion may be guided by the guide groove while the air circulator moves.

Further, the aerosol generating device may further include an opening that exposes the accommodation space to the outside, and a cover that is movable between an open position where at least a part of the opening is exposed and a closing position where the opening is covered, wherein the air circulator may move together with the cover.

Further, the cover may include an air hole through which air in the accommodation space is discharged to the outside, and a ventilation cap capable of opening or closing the air hole.

Further, the aerosol generating device may further include a controller that controls operations of the heater and the air circulator.

Further, the controller may control an operation strength of an air circulator.

Further, the controller may independently control the air circulator and the heater.

Further, the air circulator may be detachable from an aerosol generating device.

Further, the air circulator may be a sub-assembly including a terminal for receiving power, and the aerosol generating device may be electrically connected to the terminal of the air-circulating device to supply power to the air circulator when the air circulator is coupled to the aerosol generating device.

In a cleaning kit for an aerosol generating device according to another embodiment, the aerosol generating device may include an accommodation space for accommodating an aerosol generating article and a heater for heating the aerosol generating article, the cleaning kit comprising: a main body having a shape that fits in the accommodating space; and an air circulator disposed in the main body and configured to generate air flow that discharges air in the main body to outside.

Further, the cleaning kit may include a brush disposed in the main body such that the brush contacts the heater while the cleaning kit is coupled to the aerosol generating device.

Further, the air circulator may include a fan and a motor for driving the fan, and the brush may be rotated together with the fan by the motor.

Further, the main body may further include an insertion tube of a shape corresponding to the case, and the brush may be disposed inside the insertion tube to be in contact with at least a part of the heater.

Further, the main body may further include one of a protrusion and a groove corresponding to the protrusion, and wherein the air circulator includes the other of the protrusion and the groove such that the air circulator is fixed to the main body by engagement of the protrusion with the groove.

An aerosol generating system according to another embodiment may include an aerosol generating device comprising: a case comprising an accommodation space for accommodating at least a part of an aerosol generating article; and a heater disposed in the accommodation space to heat the aerosol generating article; and a cradle comprising an inner space for accommodating the aerosol generating device and configured to charge a battery of the aerosol generating device, wherein the cradle includes an air circulator configured to discharge air in the accommodation space of the aerosol generating device to the outside when the aerosol generating device is accommodated in the inner space of the cradle.

Further, the air circulator may move between a first position outside at least a part of the inner space and a second position located in the inner space.

Mode for Invention

With respect to the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, an aerosol generating device may be a device that generates aerosol by using an aerosol generating material to generate aerosol that may be directly puffed into lungs of a user through a mouth of the user. For example, the aerosol generating device may be a holder.

In the specification, a term "puff" refers to inhalation of the user, and the inhalation may mean a situation of pulling into the oral cavity, the nasal cavity, or lungs of a user through the mouth or the nose of the user. Also, it is assumed that a cigarette is used as an aerosol generating article containing an aerosol generating material in the embodiments described below. However, an aerosol generating material may be provided in any other types of aerosol generating article (e.g., a cartridge) that may be coupled to an aerosol generating device.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other components may be further included in the aerosol generating device 1, in addition to the components illustrated in FIGS. 1 through 3.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Further, the battery 11 may supply power necessary for operating an air circulation device 150 (i.e., an air circulator) which will be described below. Also, the battery 11 may supply power necessary for operating a display, a sensor, a motor, and so on installed in the aerosol generating device 1. For example, the battery 11 may be a lithium-ion battery, a nickel-based battery (for example, a nickel-metal hydride battery or a nickel-cadmium battery), or a lithium-based battery (for example, a lithium-cobalt battery, a lithium-phosphate battery, a lithium titanate battery, or a lithium-polymer battery).

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 of the aerosol generating device 1 according to an embodiment may control the air circulation device 150 which will be described below. For example, the controller 12 may control an operating strength of the air circulation device 150. Further, the controller 12 may control the air circulation device 150 independently from the battery 11 and the heater 13. Accordingly, a user may operate only the air circulation device 150 while the heater is not operating. Residual substances of a cigarette that may remain in an accommodation space after use may be removed by an operation of the air circulation device 150. Also, air in the accommodation space may be discharged to the outside by an operation of the air circulation device 150. Thus, odor or the like that may cause an unpleasant feeling to a user may be removed by ventilating the accommodation space.

The controller 12 may include at least one processor. A processor can be implemented as an array of a plurality of logic gates or can be implemented as a combination of a microprocessor and a memory in which a program executable in the microprocessor is stored. It will be understood by one of ordinary skill in the art that the processor can be implemented in other forms of hardware.

The heater 13 may heat a cigarette inserted into the aerosol generating device 1 according to power supplied from the battery 11. For example, if the cigarette is inserted into the aerosol generating device 1, the heater 13 may be inserted into the cigarette or located outside the cigarette. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further other components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor. Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1. Otherwise, the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, the opening and closing and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed in a surface of the cigarette 2.

Hereinafter, an example of the cigarette 2 will be described with reference to FIG. 4.

FIG. 4 illustrates an example of a cigarette.

Referring to FIG. 4, the cigarette 2 may include a tobacco rod 21 and a filter rod 22. The first portion 21 described above with reference to FIGS. 1 through 3 may include the tobacco rod, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

The cigarette 2 may be packaged using at least one wrapper 24. The wrapper 24 may have at least one hole through which external air may be introduced or internal air may be discharged. For example, the cigarette 2 may be packaged using one wrapper 24. As another example, the cigarette 2 may be double-packaged using at least two wrappers 24. For example, the tobacco rod 21 may be packaged using a first wrapper, and the filter rod 22 may be packaged using a second wrapper. Also, the tobacco rod 21 and the filter rod 22, which are respectively packaged using separate wrappers, may be coupled to each other, and the entire cigarette 2 may be packaged using a third wrapper. When each of the tobacco rod 21 and the filter rod 22 includes a plurality of segments, each segment may be packaged using a separate wrapper. Also, the entire cigarette 2 including the plurality of segments, which are respectively packaged using the separate wrappers and which are coupled to each other, may be re-packaged using another wrapper.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity of the tobacco rod may be increased. As a result, the taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The filter rod 22 may be formed to generate flavors. For example, a flavoring liquid may be injected onto the filter rod 22, or an additional fiber coated with a flavoring liquid may be inserted into the filter rod 22.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

The filter rod 22 may include a segment for cooling the aerosol. The cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment is capable of cooling the aerosol.

Although not illustrated in FIG. 4, the cigarette 2 according to an embodiment may further include a front-end filter. The front-end filter may be located on a side of the tobacco rod 21, the side not facing the filter rod 22. The front-end filter may prevent the tobacco rod 21 from being detached outwards and prevent the liquefied aerosol from flowing into the aerosol generating device 1 from the tobacco rod 21, during smoking.

Figure 5:
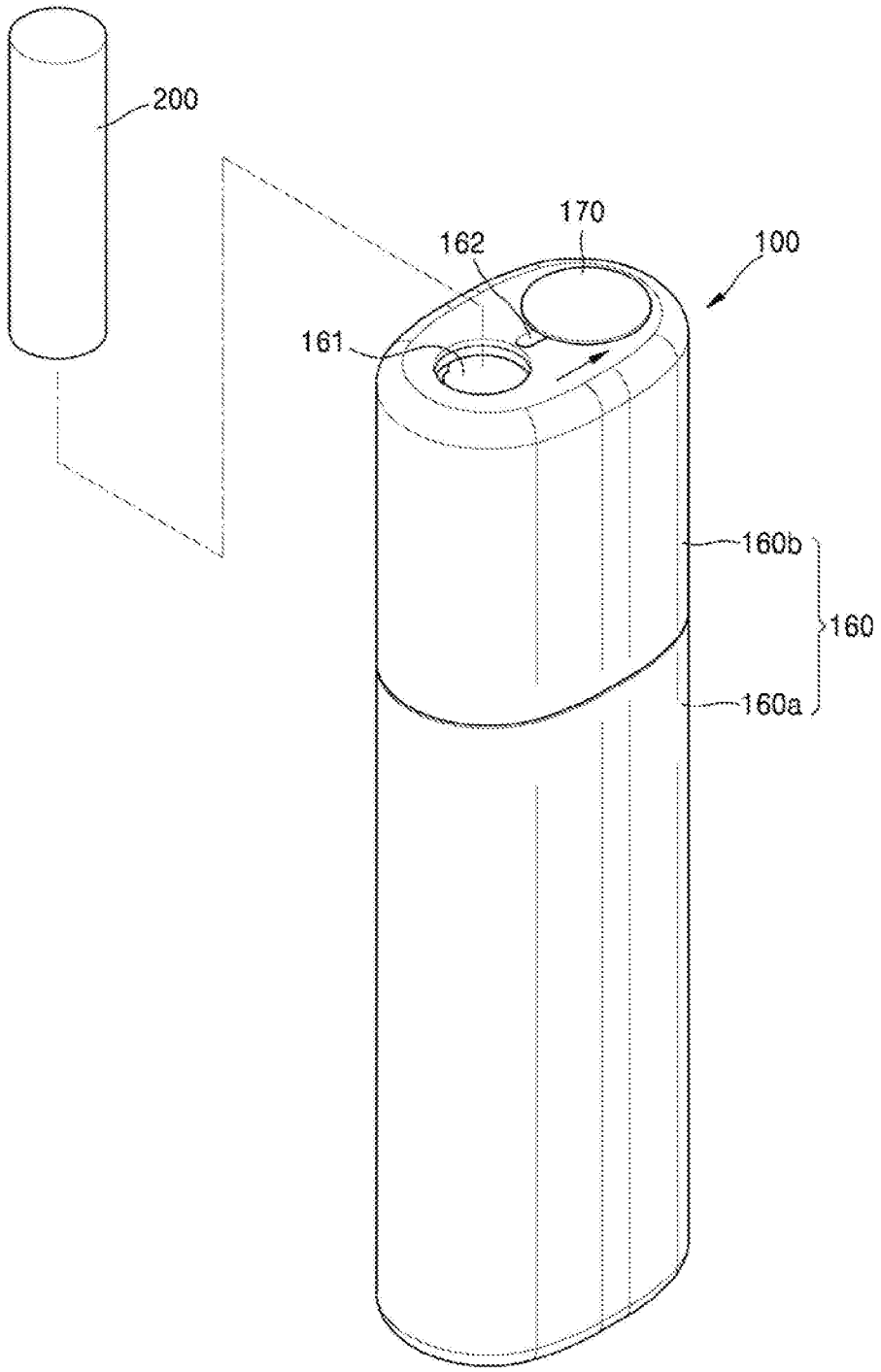
FIG. 5 is a perspective view schematically illustrating an aerosol generating device according to an embodiment.

FIG. 5 is a perspective view schematically illustrating an aerosol generating device according to an embodiment.

Referring to FIG. 5, an aerosol generating device 100 includes a housing 160 that forms an exterior of the aerosol generating device 100. In the embodiment illustrated in FIG. 5, the housing 160 may include a first housing 160*a* and a second housing 160*b*. The second housing 160*b* may be detachably coupled to one end of the first housing 160*a*, and thus, the first housing 160*a* and the second housing 160*b* forms an exterior of the aerosol generating device 100.

The first housing 160*a* forms a part of the exterior of the aerosol generating device 100 and functions to accommodate various elements therein and protect the elements.

The first housing 160*a* and the second housing 160*b* may be manufactured with a plastic material that does not transfer heat well or a metal material coated with a thermal barrier material on a surface thereof. The first housing 160*a* and the second housing 160*b* may be manufactured by using, for example, an injection molding method, a 3D printing method, or a method of assembling small components formed by injection molding.

A holding device (not illustrated) for maintaining the coupling state of the first housing 160*a* and the second housing 160*b* may be installed between the first housing 160*a* and the second housing 160*b*. The holding device may include, for example, a protrusion and a groove. By maintaining a state in which the protrusion is inserted into the groove, the coupling state of the first housing 160*a* and the second housing 160*b* may be maintained. The protrusion may move to be separated from the groove when an operation button is pressed by a user.

Further, the holding device may include, for example, a magnet and a metal member. When a magnet is used for the holding device, a magnet may be installed in one of the first housing 160*a* and the second housing 160*b* and a metal member attracted to the magnet may be installed in the other. Alternatively, magnets may be installed in both the first housing 160*a* and the second housing 160*b*.

According to an embodiment, the second housing 160*b* may be omitted. Also, the first housing 160*a* and the second housing 160*b* may be integrally formed as the housing 160.

An upper surface of the second housing 160*b* coupled to the first housing 160*a* has an opening 161 into which a cigarette 200 may be inserted. Further, a rail 162 is formed at a position adjacent to the opening 161 on the upper surface of the second housing 160*b*. A cover 170 may slide on the upper surface of the second housing 160*b* along the rail 162.

As the cover 170 may move along the rail 162 in an arrow direction in FIG. 5, the cover 170 may move between a closing position where the opening 161 is covered and an open position where at least a part of the opening 161 is exposed to the outside.

If the cover 170 moves to the open position, the opening 161 and an accommodation space are exposed to the outside so that the cigarette 200 may be inserted into the accommodation space capable of accommodating the cigarette 200. If the opening 161 is exposed to the outside by the cover 170, a user may insert the end of the cigarette 200 into the opening 161 such that the cigarette 200 is accommodated in the accommodation space formed inside the second housing 160*b*.

Further, if the cover 170 moves to the closing position where the opening 161 and the accommodation space are covered, the inside of the accommodation space may be safely protected from foreign substances. Accordingly, the aerosol generating device 100 may be maintained clean while not in use.

In the embodiment illustrated in FIG. 5, the cover 170 is installed to move linearly with respect to the second housing 160*b*. However, the embodiment is not limited by the structure shown in FIG. 5. For example, the cover 170 may be rotatably coupled to the second housing 160*b* through a hinge assembly. When the hinge assembly is used, the cover 170 may rotate to the side of the opening 161 in a direction in which an upper surface of the second housing 160*b* extends, or the cover 170 may rotate in a direction in which the cover becomes distant from the upper surface of the second housing 160*b*.

The rail 162 has a concave groove shape, but the embodiment is not limited by the shape of the rail 162. For example, the rail 162 may have a convex shape or may extend in a curved shape rather than a linear shape.

A button (not illustrated) may be installed in the first housing 160*a* so that a user controls an operation of the aerosol generating device 100 by using the button.

In a state in which the second housing 160*b* is coupled to the first housing 160*a*, an external air inlet gap (not illustrated) may be formed between the first housing 160*a* and the second housing 160*b* such that air may flow into the second housing 160*b*.

Figure 6:
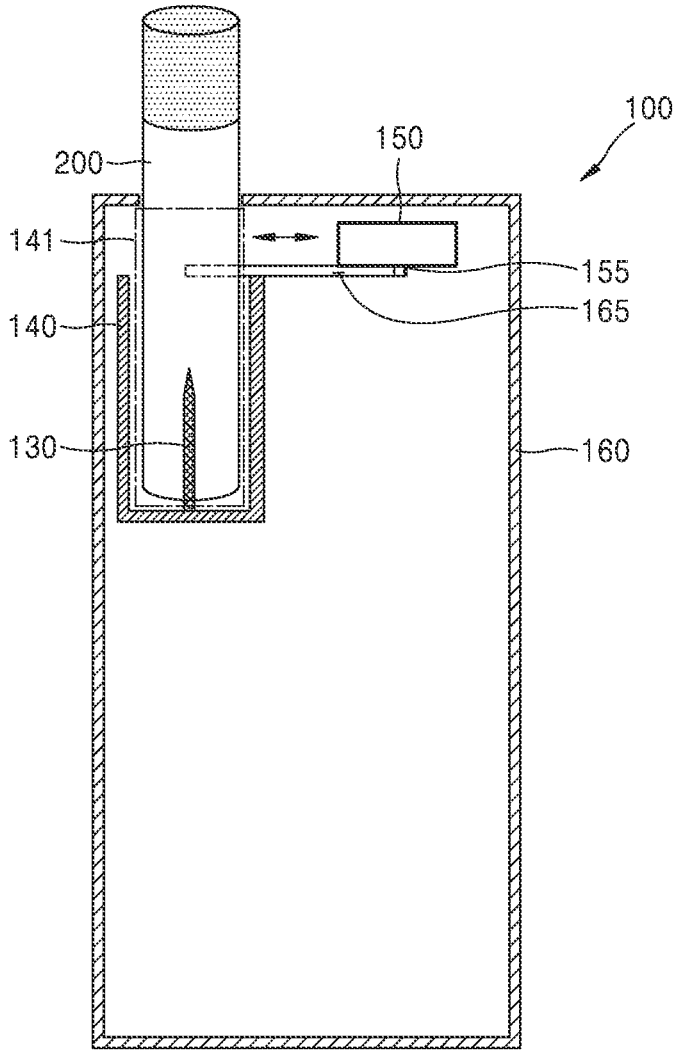
FIG. 6 is a cross-sectional view schematically illustrating an example of one operation state of the aerosol generating device illustrated in FIG. 5.
Figure 7:
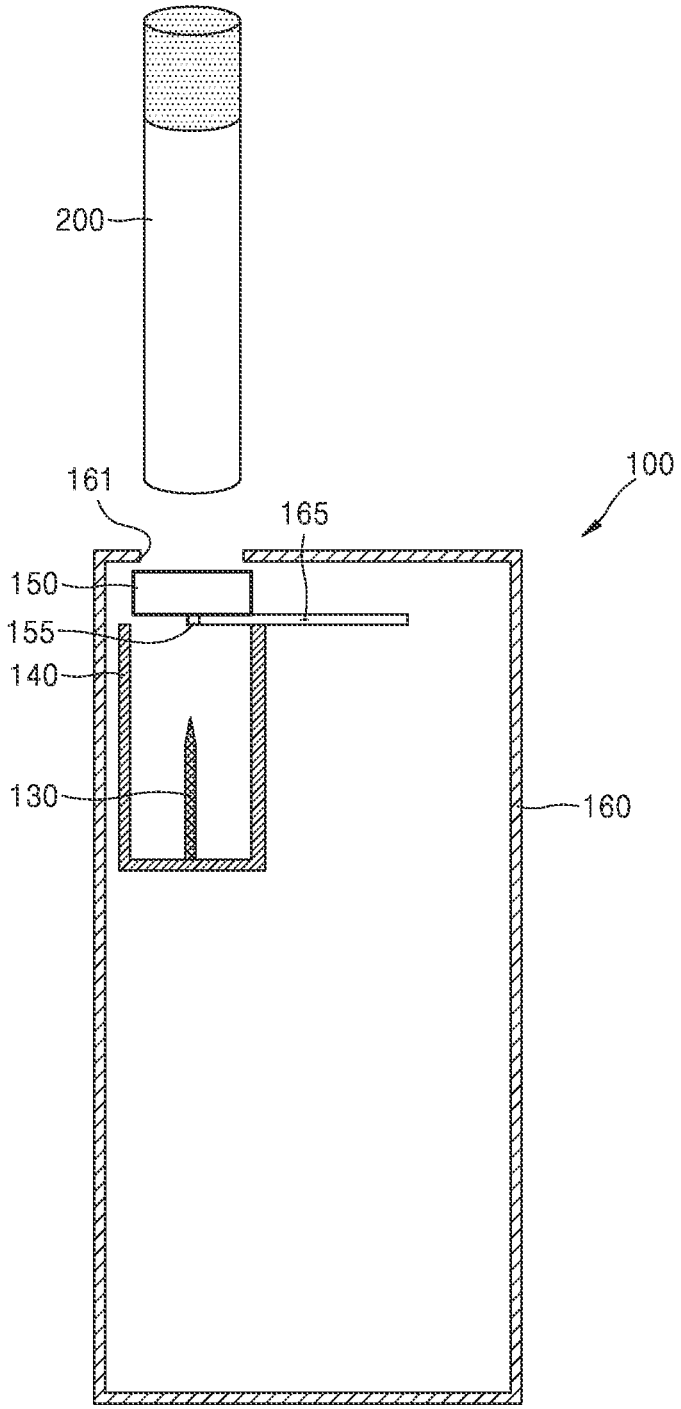
FIG. 7 is a cross-sectional view schematically illustrating an example of another operation state of the aerosol generating device illustrated in FIG. 5.

FIG. 6 is a cross-sectional view schematically illustrating an example of one operation state of the aerosol generating device according to the embodiment illustrated in FIG. 5, and FIG. 7 is a cross-sectional view schematically illustrating an example of another operation state of the aerosol generating device according to the embodiment illustrated in FIG. 5.

Referring to FIG. 6, the cigarette 200 is inserted into the aerosol generating device 100 and is heated by the heater 130. The aerosol generating device 100 includes a case 140 that forms the accommodation space 141 for accommodating at least a part of the cigarette 200, a heater 130 that heats the cigarette 200 accommodated in the accommodation space 141 to generate aerosol, and the air circulation device 150.

The air circulation device 150 may generate a flow of air and may include a device capable of generating the flow of air, such as a fan and an air pump. In the operation state of FIG. 6, the air circulation device 150 is at a first position outside the accommodation space.

Referring to FIG. 7, a state in which the cigarette 200 is separated from the aerosol generating device 100 is illustrated. As shown in FIG. 7, if the cigarette 200 is separated from the accommodation space 141, the air circulation device 150 may be disposed in the accommodation space 141. For example, a second position represents a state in which the air circulation device 150 is moved to be located in the accommodation space. Since the air circulation device 150 operates in the accommodation space 141, air may be discharged to the outside of the accommodation space 141. In other words, the air circulation device 150 may generate a flow of air directed outward, and thus, liquid droplets and by-products of the cigarette 200 may be discharged to the outside.

As described above, the first position and the second position may indicate a position of the air circulation device 150. For example, at the first position, the air circulation device 150 is partially or entirely outside the accommodation space 141 so that the cigarette 200 may be accommodated inside the accommodation space 141. At the second position, the air circulation device 150 is located in the accommodation space 141 to discharge air to the outside of the accommodation space 141.

As shown in FIGS. 6 and 7, the air circulation device 150 may move between the first position and the second position.

Moreover, although not illustrated in FIGS. 6 and 7, the aerosol generating device 100 may include a guide groove formed in the housing 160 and a protrusion formed in the air circulation device 150 to engage with the guide groove of the housing 160. Accordingly, the protrusion of the air circulation device 150 is guided by the guide groove of the housing 160 while the air circulation device 150 moves, and thus, the air circulation device 150 may move stably in an inner space of the housing 160 between the first position and the second position.

Further, the air circulation device 150 may be separable from the aerosol generating device 100. For example, the housing 160 may include an insertion opening through which the air circulation device 150 may be inserted. A user may remove a cover 170, and assemble the air circulation device 150 to the aerosol generating device 100 or separate the air circulation device 150 from the aerosol generating device 100, through the insertion opening.

Further, the air circulation device 150 may be a subassembly including a terminal (not illustrated) that receives power. When the air circulation device 150 is assembled to the aerosol generating device 100, the terminal of the air circulation device 150 may be electrically connected to the aerosol generating device 100 to receive power from the battery 11.

Accordingly, when the user wants to use the aerosol generating device 100, the user can separate the air circulation device 150 from the aerosol generating device 100. Also, after completion of using the aerosol generating device 100, the user may assemble the air-circulating device 150 in the accommodation space 141 of the aerosol generating device 100 to ventilate the accommodation space 141. Further, when the air circulation device 150 needs to be replaced, the user may separate the air circulation device 150 from the aerosol generating device 100 and install a new one.

FIG. 8 is a perspective view illustrating a cover of an aerosol generating device according to an embodiment.

Referring to FIG. 8, the air circulation device 150 may be coupled to the cover 170 so that the air circulation device 150 moves together with the cover 170. Accordingly, if the cover 170 moves between the open position and the closing position, the air circulation device 150 may move between the first position and the second position together with the cover 170. For example, when a user moves the cover 170 to the open position to insert the cigarette 200 into the opening 161, the air circulation device 150 moves to the first position outside the accommodation space 141. If the user moves the cover 170 to the closing position, the air circulation device 150 moves to the second position located in the accommodation space 141. The air circulation device 150 at the second position may operate to discharge air in the accommodation space 141 to the outside.

The cover 170 may include an air hole 171 through which air is smoothly discharged from the accommodation space 141 to the outside. Also, the cover 170 may also include a ventilation cap 172 for opening or closing the air hole 171. The air hole 171 illustrated in FIG. 8 has a fan shape, but it is not limited thereto. The ventilation cap 172 may have a shape corresponding to the shape of the air hole 171. The ventilation cap 172 may rotate to open or close the air hole 171 The opening and closing operations of the ventilation cap 172 may be performed by a motor which may be driven by the controller 12. Moreover, the shape and the opening and closing operations of the ventilation cap 172 are not limited to the above-described embodiment. For example, the ventilation cap 172 may have an aperture shape, and the ventilation cap 172 may be opened or closed in the same manner as an opening or closing method of an aperture.

FIG. 9 is a perspective view schematically illustrating a cleaning kit for an aerosol generating device according to another embodiment, and FIG. 10 is a cross-sectional view illustrating a side of the cleaning kit illustrated in FIG. 9.

Referring to FIGS. 9 and 10, a cleaning kit 180 for an aerosol generating device may include a main body 181 that may be inserted into the accommodation space 141. The main body 181 may have a shape that fits in the accommodation space 141. The cleaning kit 180 may also include the air circulation device 150 that is installed in the main body 181 and discharges air in the main body 181 to the outside. Accordingly, after the cigarette 200 is removed from the accommodation space 141, the cleaning kit 180 may be coupled to the accommodation space 141, and the air circulation device 150 may discharge air from the accommodation space 141 to the outside.

The cleaning kit 180 may further include at least one brush 183, which may be in contact with at least a part of the heater 130 when the cleaning kit 180 is coupled to the aerosol generating device 100. Accordingly, the cleaning kit 180 may effectively remove foreign substances attached to the heater 130 by the brush 183.

The air circulation device 150 may include a fan 151 and a motor (not illustrated) that drives the fan 151. The brush 183 may be rotated together with the fan 151 by a motor. For example, the brush 183 may rotate around the heater 130 or may rotate about a longitudinal axis of the brush 183.

Further, the brush 183 may rotate about the longitudinal axis while rotating around the heater 130. Accordingly, the cleaning kit 180 may further maximize a cleaning effect by the brush 183.

The main body 181 of the cleaning kit 180 may include an insertion tube 182 having a shape corresponding to the case 140. The brush 183 may be disposed inside the insertion tube 182 to be in contact with at least a part of the heater 130. Since the heater 130 comes into contact with the aerosol generating material in the cigarette 200, foreign substances often remain on the surface of the heater 130. Accordingly, the main body 181 of the cleaning kit 180 may stably support the cleaning kit 180 while maintaining the cleaning effect of the brush 183.

Further, the main body 181 of the cleaning kit 180 may further include a fixing portion for fixing the air circulation device 150. For example, the fixing portion may include one of a protrusion supporting the air circulation device 150 and a groove capable of engaging with the protrusion, and the air circulation device 150 may include the other of the protrusion and the groove. The protrusion may extend along an inner circumferential surface of the main body 181. However, the shape of protrusion is not limited thereto.

Further, the fixing portion for fixing the air circulation device 150 may also be included in the housing 160 of the aerosol generating device 100 according to an embodiment.

FIG. 11 is a perspective view schematically illustrating an aerosol generating system including an aerosol generating device and a cradle according to an embodiment.

Referring to FIG. 11, the aerosol generating system may include an aerosol generating device 100' and a cradle 1000 that accommodates the aerosol generating device 100' and charges the battery 110 of the aerosol generating device 100'. The aerosol generating device 100' according to the embodiment of FIG. 11 may be inserted into an inner space 1200 of the cradle 1000. The aerosol generating device 100' may be similar to those explained above with reference to FIGS. 1-10, so its detailed description will be omitted.

In an aerosol generating system according to an embodiment, the aerosol generating device 100' may be accommodated in the cradle 1000 and charged. The cradle 1000 may include a battery 1100 therein, and the aerosol generating device 100' according to the embodiment may be inserted into the cradle 1000 and electrically connected to the charging power supply 1100 of the cradle 1000. Subsequently, the battery 11 of the aerosol generating device 100' according to the embodiments may be charged by the battery 1100 of the cradle 1000.

The cradle 1000 may include an inner space 1200 that may accommodate the aerosol generating device 100'. Also, the cradle 1000 may include the air circulation device 1300.

The air circulation device 1300 may generate a flow of air like the air circulation device 150 according to the embodiments described above. Accordingly, if the aerosol generating device 100' is accommodated in the inner space 1200 of the cradle 1000, the air circulation device 1300 may be disposed in the inner space 1200 of the cradle 1000 to discharge air in the accommodation space of the aerosol generating device 100' to the outside.

Further, a first position and a second position may be defined according to a position of the air circulation device 1300 similarly to the embodiment illustrated in FIGS. 6 and 7. For example, at the first position, the air circulation device 1300 may be located entirely or partially outside the inner space 1200. At the second position, the air circulation device 1300 may be located in the inner space 1200. The air circulation device 1300 may move between the first position and the second position.

Moreover, the heater of the aerosol generating device 100' may be heated while the aerosol generating device 100' is coupled to the cradle 1000. Although not illustrated in FIG. 11, the aerosol generating device 100' may be tilted inside the cradle 1000. In other words, the aerosol generating device 100' may be inclined at a certain angle in a state of being inserted into the cradle 1000.

The aerosol generating system according to the embodiment illustrated in FIG. 11 may operate the air circulation device 1300 located in the inner space 1200 while the aerosol generating device 100' is coupled to the cradle 1000. Specifically, the air circulation device 1300 may be disposed above the opening of the aerosol generating device 100' in the inner space 1200 and generate a flow of air toward the outside such that air in the accommodation space of the aerosol generating device 100' may be discharged to the outside. Accordingly, liquid droplets and by-products of a cigarette may be discharged to the outside, and odor remaining in the accommodation space of the aerosol generating device 100' may be removed.

At least one of the components, elements, modules or units (collectively "components" in this paragraph) represented by a block in the drawings, such as the controller 12 in FIGS. 1-3, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

a case including an accommodation space for accommodating at least a part of an aerosol generating article;

a heater that heats the aerosol generating article accommodated in the accommodation space to generate aerosol; and an air circulator that generates air flow such that air in the accommodation space is discharged to outside by passing through the air circulator.

2. The aerosol generating device of claim 1, wherein the air circulator is configured to move to cover and uncover the accommodation space.

3. The aerosol generating device of claim 2, further comprising:

a housing that forms an exterior of the aerosol generating device;

a guide groove formed in the housing; and a protrusion formed in the air circulator to engage with the guide groove, wherein the protrusion is guided by the guide groove while the air circulator moves.

4. The aerosol generating device of claim 2, further comprising:

an opening that exposes the accommodation space to the outside; and a cover that is movable between an open position where at least a part of the opening is exposed to the outside and a closing position where the opening is covered by the cover;

wherein the air circulator moves together with the cover.

5. The aerosol generating device of claim 4, wherein the cover includes an air hole through which air in the accommodation space is discharged to the outside, and a ventilation cap configured to open and close the air hole.

6. The aerosol generating device of claim 1, further comprising a controller that controls an operation strength of the air circulator.

7. The aerosol generating device of claim 1, further comprising:

a battery that supplies power to the heater and the air circulator; and a controller that controls the air circulator and the heater independently.

8. The aerosol generating device of claim 1, wherein the air circulator is a sub-assembly detachable from the aerosol generating device and includes a terminal for receiving power, and wherein the aerosol generating device is electrically connected to the terminal of the air circulator to supply power to the air circulator when the air circulator is coupled to the aerosol generating device.

9. A cleaning kit for an aerosol generating device that includes an accommodation space for accommodating an aerosol generating article and a heater for heating the aerosol generating article, the cleaning kit comprising:

a main body having a shape that fits in the accommodating space; and an air circulator disposed in the main body and configured to generate air flow such that air in the main body is discharged to outside by passing through the air circulator.

10. The cleaning kit of claim 9, further comprising a brush disposed in the main body such that the brush contacts the heater while the cleaning kit is coupled to the aerosol generating device.

11. The cleaning kit of claim 10, wherein the air circulator includes a fan and a motor for driving the fan, and wherein the brush is rotated together with the fan by the motor.

12. The cleaning kit of claim 10, wherein the main body further includes an insertion tube having a shape corresponding to a case of the aerosol generating device which forms the accommodation space, and wherein the brush is disposed inside the insertion tube.

13. The cleaning kit of claim 9, wherein the main body includes one of a protrusion and a groove corresponding to the protrusion, and wherein the air circulator includes the other of the protrusion and the groove such that the air circulator is fixed to the main body by engagement of the protrusion with the groove.

14. An aerosol generating system comprising:

an aerosol generating device comprising:

a case comprising an accommodation space for accommodating at least a part of an aerosol generating article; and a heater disposed in the accommodation space to heat the aerosol generating article; and a cradle comprising an inner space for accommodating the aerosol generating device and configured to charge a battery of the aerosol generating device, wherein the cradle includes an air circulator configured to generate air flow such that air in the accommodation space of the aerosol generating device is discharged to outside by passing through the air circulator when the aerosol generating device is accommodated in the inner space of the cradle.

15. The aerosol generating system of claim 14, wherein the air circulator is configured to move to cover and uncover the inner space of the cradle.

* * * * *